US011318477B2

(12) United States Patent
Schiffers et al.

(10) Patent No.: US 11,318,477 B2
(45) Date of Patent: May 3, 2022

(54) MAGNETIC SEPARATOR

(71) Applicant: Loesche GmbH, Düsseldorf (DE)

(72) Inventors: Andreas Schiffers, Düsseldorf (DE); André Bätz, Düsseldorf (DE); Carsten Gerold, Düsseldorf (DE)

(73) Assignee: LOESCHE GMBH, Düsseldorf (DE)

( * ) Notice: Subject to any disclaimer, the term of this patent is extended or adjusted under 35 U.S.C. 154(b) by 189 days.

(21) Appl. No.: 16/490,829

(22) PCT Filed: Mar. 29, 2017

(86) PCT No.: PCT/EP2017/057408
§ 371 (c)(1),
(2) Date: Sep. 3, 2019

(87) PCT Pub. No.: WO2018/177518
PCT Pub. Date: Oct. 4, 2018

(65) Prior Publication Data

US 2020/0001305 A1 Jan. 2, 2020

(51) Int. Cl.
*B03C 1/30* (2006.01)
*B03C 1/14* (2006.01)
*B03C 1/26* (2006.01)

(52) U.S. Cl.
CPC ..... *B03C 1/14* (2013.01); *B03C 1/26* (2013.01); *B03C 1/30* (2013.01); *B03C 2201/20* (2013.01)

(58) Field of Classification Search
CPC ..... B03C 1/0332; B03C 1/14; B03C 1/145; B03C 1/26; B03C 1/30; B03C 2201/20; B03C 2201/22
(Continued)

(56) References Cited

U.S. PATENT DOCUMENTS 438,357 A * 10/1890 McMahan ..... B03C 1/14 209/219
500,604 A * 7/1893 Payne ..... B03C 1/14 209/214
(Continued)

FOREIGN PATENT DOCUMENTS

CN 102794228 A 11/2012
CN 102806141 A 12/2012
(Continued)

OTHER PUBLICATIONS

Chinese Office Action dated Oct. 30, 2020 relating to CN Patent Application No. 201780089221.2.
(Continued)

*Primary Examiner* — Joseph C Rodriguez
(74) *Attorney, Agent, or Firm* — Dinsmore & Shohl LLP

(57) ABSTRACT

A magnetic separator for the dry separation of material particles having different magnetic susceptibilities includes a rotatable cylinder that has a stationary magnetic device arranged therein, and extending essentially across its length. A sorting chamber is furthermore provided for which extends along at least a portion of the outer surface of the cylinder in the circumferential direction of the cylinder and parallel to the longitudinal axis of the cylinder. The magnetic separator includes means for the dispersed output of material particles into the sorting chamber, as well as means for generating a stream of conveying air in the sorting chamber. A motor for rotating the cylinder around its longitudinal axis is included, wherein, during operation, the outer surface of the cylinder is moved by the rotation of the cylinder in a direction essentially perpendicular to the direction of the stream of conveying air.

13 Claims, 5 Drawing Sheets

Figure 1:
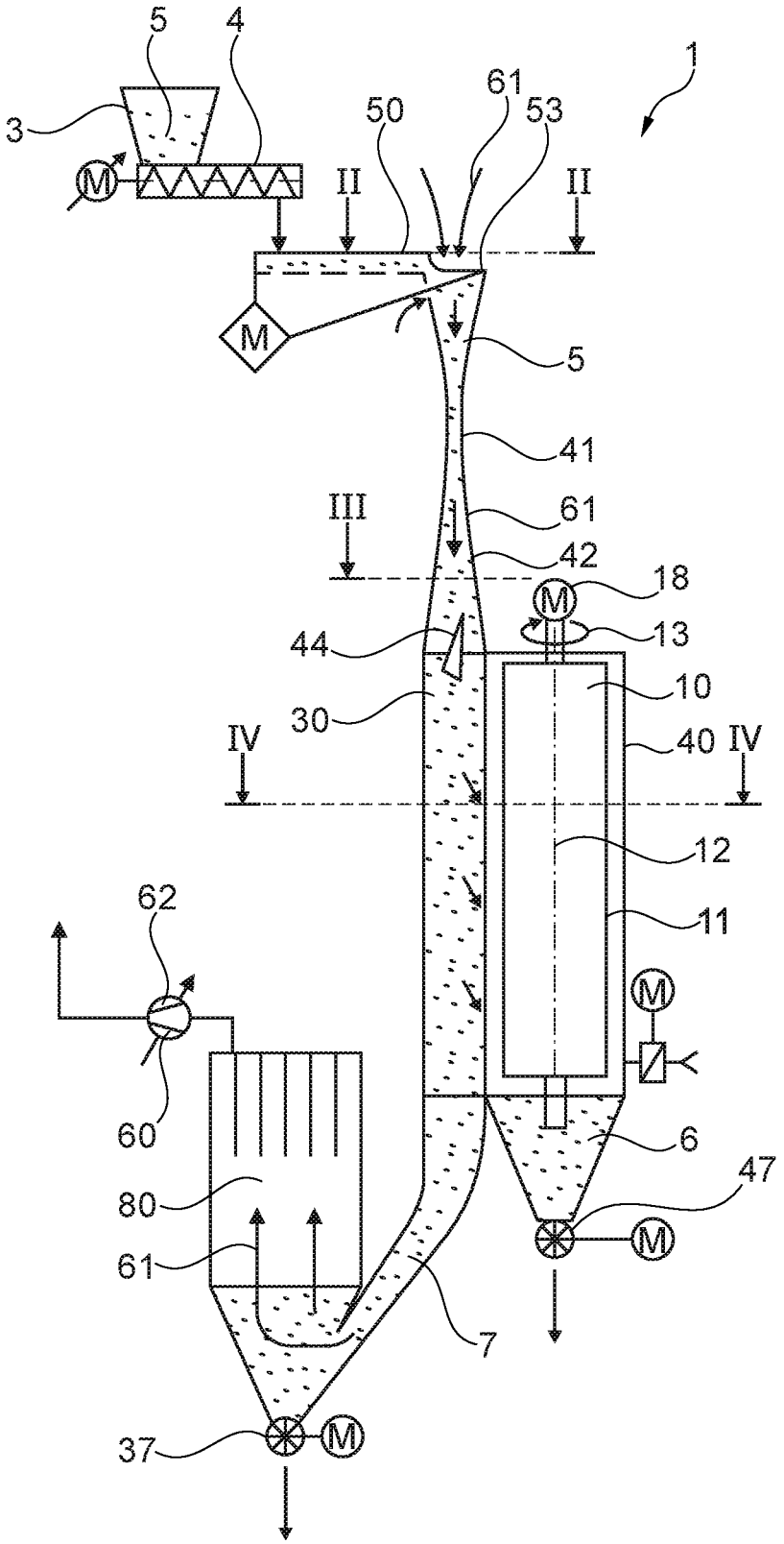

(58) Field of Classification Search
USPC ..... 209/39, 223.1, 223.2, 232
See application file for complete search history.

(56) References Cited

U.S. PATENT DOCUMENTS

| | | | | |
|---|---|---|---|---|
| 1,527,069 | A * | 2/1925 | Peck, Jr. | B03C 1/30 209/214 |
| 2,711,249 | A | 6/1955 | Laurila | |
| 4,051,023 | A | 9/1977 | Fogle et al. | |
| 4,080,760 | A * | 3/1978 | Leliaert | B24C 9/006 451/88 |
| 4,144,163 | A * | 3/1979 | Kolm | B03C 1/03 209/12.2 |
| 4,359,382 | A * | 11/1982 | Morgan | B03C 1/14 209/223.2 |
| 4,478,711 | A | 10/1984 | Cohen et al. | |
| 7,743,926 | B2 * | 6/2010 | Lewis-Gray | B03C 1/145 209/223.2 |
| 8,196,751 | B2 * | 6/2012 | Shuttleworth | B03C 1/14 209/215 |
| 8,807,344 | B2 * | 8/2014 | Keaton | B03C 1/14 209/223.2 |
| 9,375,727 | B2 * | 6/2016 | Molteni | F16C 33/4605 |
| 2013/0146510 | A1 | 6/2013 | Ross | |
| 2014/0083920 | A1 * | 3/2014 | Nishizawa | B03C 1/14 210/223 |
| 2019/0143373 | A1 * | 5/2019 | Sugiura | B24C 9/00 209/39 |

FOREIGN PATENT DOCUMENTS

| | | | |
|---|---|---|---|
| CN | 103476504 | A | 12/2013 |
| CN | 103945926 | A | 7/2014 |
| CN | 104128260 | A | 11/2014 |
| CN | 204892118 | U | 12/2015 |
| CN | 105797845 | A | 7/2016 |
| DE | 965301 | C | 6/1957 |
| DE | 2949855 | A1 | 6/1981 |
| DE | 19510116 | A1 | 9/1996 |
| DE | 202012010543 | U1 | 2/2014 |
| EP | 2604347 | A1 | 6/2013 |
| GB | 12368 | A | 12/1913 |
| GB | 100064 | A | 3/1916 |
| JP | H10138083 | A | 5/1998 |
| TW | 201343258 | | 11/2013 |

OTHER PUBLICATIONS

PCT Notification of Transmittal of Translation of the International Preliminary Report on Patentability, International Application No. PCT/EP2017/057408, dated Oct. 3, 2019.

Taiwan Application No. 107110865 Examination Report, dated Dec. 23, 2021.

Australian Application No. 2017406401 Examination Report No. 1 for standard patent application, dated Dec. 15, 2021.

* cited by examiner

MAGNETIC SEPARATOR

The invention relates to a magnetic separator for the dry separation of material particles having different magnetic susceptibilities.

The growing scarcity of water, as well as the poor or insufficient availability of water, in various regions, together with high costs and local environmental requirements regarding the use of wet treatment methods, in particular for mineral resources, have contributed towards alternative dry treatment methods, hence methods not requiring water, gaining in importance.

Ores are often mined from solid rock. The raw product in this case contains valuable ore minerals that have evolved, together with worthless accompanying minerals, which are also known as gangue. In order to separate these from one another, it is, for example, known, with treatment or separation methods, for the solid rock to be fed into a multi-stage comminution process, so that the ore minerals and the gangue are separated from one another through the refinement achieved. The subsequent sorting of the ore mineral from the gangue can be carried out making use of various properties of the two products to be sorted. It should be kept in mind, in this context, that, the finer the degree of adhesion in the raw material, the finer it will also have to be comminuted. This means that comminution down to a particle diameter in the range of approximately 100 μm or smaller will sometimes be necessary.

Precisely in light of the fact that the quality of ore deposits is decreasing worldwide, it is becoming increasingly laborious to treat and subsequently sort the corresponding solid rock.

Taking these two issues referred to above into consideration, i.e. firstly the necessity of increasingly fine comminution or higher liberation ratios, as well as, secondly, the scarcity of water, it is desirable to provide for dry sorting processes which taken into account the properties, for instance, of iron ores, but also other ores, such as, for example, chromium ores, titanium ores, copper ores, cobalt ores, tungsten ores, manganese ores, nickel ores, tantalum ores, or numerous different rare earth ores. The invention can furthermore also be used for the treatment of secondary mineral resources, such as slags, ashes, and other blast furnace remnants, for example filter dust or tinder, if magnetic or magnetizable components are supposed to be concentrated or separated. In this context, separation can be carried out based on the fact that the ores and the gangue have different magnetic susceptibilities.

In this connection, a variety of wet treatment systems or wet drum magnetic separators are known for separation, which essentially function using water as a carrier medium, and which, in terms of fineness, can be used for a large number of particle sizes.

However, precisely in light of the increasing scarcity of water, as well as the increased expenditure of transporting water to remote arid areas, there is a desire, as just mentioned, to operate dry magnetic separation systems, which can be used for separation in the fine particle size range of less than 100 μm, as well. Various dry magnetic separation methods are also already known, in this respect, such as, for example, from GB 624 103 or DE 2 443 487, but their operation at fineness levels of less than 100 μm is only partially satisfactory.

Therefore, the object of the invention is to create a magnetic separator for the dry separation of material particles having different magnetic susceptibilities and suitable for use in a wide range of particle sizes, in particular also with sizes of less than 100 μm.

This problem is solved, according to the invention, by a magnetic separator having the features of claim 1.

Preferential embodiments of the invention are specified in the dependent claims and in the description, as well as in the drawings and the explanations thereof.

It is provided for that the magnetic separator according to the invention includes a cylinder able to rotate around the longitudinal axis of the magnetic separator as well as a stationary magnetic device arranged within the cylinder and extending essentially across the length of the cylinder. The magnetic device is designed in order to generate a magnetic field essentially continuous in a longitudinal direction of the cylinder.

Furthermore provided is a sorting chamber, which extends along the height of the cylinder and at least a portion of the outer surface of the cylinder in the circumferential direction of the cylinder and parallel to its longitudinal axis. It is advantageous in this context for the sorting chamber to have, in its cross-section, a maximum width corresponding essentially to the width of the magnetic device and to have a maximum depth corresponding essentially to half the width of the magnetic device.

The magnetic separator additionally features means for the dispersed output of material particles into the sorting chamber and means for generating a stream of conveying air through the sorting chamber wherein, during operation, the material particles are conveyed through the sorting chamber by means of the stream of conveying air.

In addition, an engine is provided for, for rotating the cylinder around its longitudinal axis, wherein, during operation, the outer surface of the cylinder is moved by the cylinder being rotated in a direction essentially perpendicular to the direction of the stream of conveying air, and wherein the magnetic device and the cylinder are designed and orientated with respect to one another in such a way that both the portion of the outer surface having the sorting chamber and the interior of the sorting chamber have a magnetic field essentially strong enough to attract material particles onto the outer surface.

The invention is based on a number of fundamental ideas and findings that function in combination with one another. On the one hand, it was recognized that, in order for the magnetic separator to be effective, it is necessary for the sorting chamber, through which the stream of conveying air flows, along with the dispersed output of material particles, to have a magnetic field strong enough for the various material particles to be separated, depending on their differing magnetic susceptibilities. For this purpose, it is preferable for the sorting chamber to be dimensioned in such a way that the magnetic field generated by the magnetic device extends at least within the sorting chamber, in particular the portion thereof running along the cylinder.

As an alternative or as an option, this can be guaranteed in a similar fashion by the stream of conveying air having the material particles dispersed into it being conveyed through the sorting chamber in such a way that, in all probability, all of the particles are conveyed through a sufficiently strong magnetic field. This can, for example, be accomplished by deflectors or the equivalent in the sorting chamber. A design of this kind also falls under the fundamental idea of the invention, which is realized by way of the magnetic separator according to the invention.

In prevalent magnetic devices, this can, for example, be achieved by the sorting chamber being dimensioned in such a way that a cross-section thereof has a maximum width corresponding essentially to the width of the magnetic device, as well as a maximum depth corresponding to essentially half the width of the magnetic device. It should be kept in mind, in this regard, that the maximum depth also depends upon the strength of the magnetic field. It is possible to deviate from the latter insofar as a stronger magnetic device is used.

On the other hand, it has also been recognized in accordance with the invention that, in addition to the availability of a sufficient magnetic field within the sorting chamber, it is beneficial to the sorting performance for a continuous magnetic field to be formed in a longitudinal direction along the cylinder, thus also extending across a large portion of the sorting chamber. This offers the advantage that, firstly, the magnetic field can act on the material particles that are to be separated across essentially the entire length of the sorting chamber. The other advantage arising thereby is that, unlike with an intermittent magnetic field, a magnetic field is continuously acting on the material particles in the sorting chamber while they are being transported, rather than being temporarily interrupted. This leads to better sorting performance. It should also be kept in mind that, with an intermittent magnetic field, the material particles attracted to the outer surface of the cylinder by the magnetic field are, at least for a brief period, no longer exposed to a magnetic field, and are consequently detached from the outer surface again.

Finally, the invention is also based upon the finding that, for material particles having different magnetic susceptibilities to be separated with the greatest purity possible, better performance is achieved when it is provided for that the stream of conveying air flow in a direction essentially perpendicular to the direction of rotation of the cylinder. This leads to the material particles attracted to the cylinder being rapidly removed from the sorting chamber by the rotation of the cylinder. Should an excessively thick layer of material particles attracted accumulate on the cylinder, then the overall magnetic field will thus be weakened, which in turn leads to poorer sorting or separating performance.

It has also been ascertained, in this respect, that separation performance benefits when the sorting or separating is carried out using a uniform flow. This means that the conveying air in the system, or rather the airflow in the system, runs in the same direction as the flow of material particles, hence running in uniform flow.

In principle, the magnetic device can be designed in any desired way. It has transpired, however, that the use of a tripolar magnet having an N-S-N or an S-N-S orientation of the poles is advantageous. In this context, N stands for North pole, and S for South pole. This may relate to either a permanent magnet or a solenoid. In terms of the invention, a tripolar magnet can be designed by means of the central pole acting as a sort of double or common pole, with the lines of force running between the central pole and the two respective external poles. One advantage in using a tripolar magnet is that, depending on the geometry of the sorting space and the design of the magnetic device, the magnetic lines of force are concentrated in the middle of the sorting space, so that a higher degree of efficiency is achieved and a strong magnetic field can be generated, to act on the material particles.

A collecting chamber that is connected to the sorting chamber may be provided for in the direction of rotation of the cylinder, said collecting chamber being located predominantly outside the magnetic field of the magnetic device. Since the magnetic field in the collecting chamber no longer acts on the outer surface of the cylinder, the material particles originally attracted to the outer surface of the cylinder are also no longer attracted to it, or rather no longer adhere to it. This means that the material particles in the collecting chamber will be detached and fall away from the outer surface of the cylinder. In other words, it is possible, by means of this construction, to receive material particles conveyed from the sorting chamber in the collecting chamber, and to further discharge them from there. In this context, it is preferable for the magnetic field to essentially extend only within the sorting chamber, so that the collecting chamber can be provided for in such a way that it is connected to the sorting chamber, preferably directly.

It is furthermore possible to form cam bars on the outer surface of the cylinder. These cam bars, which preferably extend parallel to the longitudinal axis of the cylinder, improve the removal of the material particles, which are attracted to the outer surface of the cylinder by means of the magnetic field. The cam bars serve, or rather help to ensure that, instead of remaining within the sphere of action of the magnetic field, the material attracted is conveyed away from the magnetic field, despite the rotation of the drum, thus allowing the drum to slide beneath the material.

When the magnetic separator is in operation, it is advantageous for the static pressure present in the collecting chamber to be higher than that in the sorting chamber. Through this difference in pressure, an airflow is regulated leading from the collecting chamber to the sorting chamber. What is accomplished through this is not that the non-magnetizable or less strongly magnetizable material particles can flow from the sorting chamber into the collecting chamber, but rather that a transport of material from the sorting chamber to the collecting chamber is essentially only carried out by way of material particles being attracted to the outer surface of the cylinder. In consequence, the difference in pressure between the two chambers generates a sealing counterflow orientated against the direction in which the attracted material is being transported.

Advantageously, a sealing area, by means of which the airflow from the collecting chamber into the sorting chamber is adjustable and variable, is formed in the area between the outer surface of the cylinder, the sorting chamber and the collecting chamber. By means of said airflow, additional purification of the resulting product can be carried out, which preferably consists of nothing more than magnetizable material particles. Said airflow, which flows through the sealing area between the collecting chamber and the sorting chamber and towards the collecting chamber, pulls some of the material particles that have collected on the outer surface of the cylinder along back into the sorting chamber. Given that non-magnetic particles are covered by magnetic particles, non-magnetic particles are also deposited on the outer surface of the cylinder, this results is the non-magnetic particles being blown off again along with a certain portion of the magnetizable material particles and make their way back into the sorting chamber. Once there, they are again fed into the continuous sorting process, thus increasing the probability that the non-magnetizable material particles will not be redeposited and increasing the purity of the magnetized material thereby.

As an alternative, distinct blower nozzles or cleaning nozzles can be optionally provided for this purpose and used to blow air against the outer surface of the cylinder. This distinct blowing of air, which can be referred to as air cleaning, has the same effect as the flow of air through the sealing area. The purity of the end product can be controlled through the option of regulating the flow of air or adjusting the air by means of the blower nozzles.

In principle, the means for generating the stream of conveying air through the sorting chamber can be designed in any desired manner. For example, air can be actively blown into the sorting chamber. However, it is advantageous for the magnetic separator to be operable at a negative pressure in relation to the environment by means of a blower, which draws air from the magnetic separator. Operating the device at a negative pressure has the advantage of very finely comminuted material particles remaining in the interior of the magnetic separator and not escaping from the separator through any openings. Problems with dust pollution, etc. in the environment will be reduced as a result. In terms of the invention, "air" or "conveying air" can, however, mean ambient air, but also relevant gases, such as process gases, process air, etc.

As a result, it is preferable for a dust removal filter to be arranged after the sorting chamber, and for a blower to be provided for the magnetic separator, arranged after the dust removal filter. Such a construction enables the non-magnetizable particles that were conveyed through the sorting chamber to be separated from the stream of conveying air by means of the dust removal filter. Arranging a blower for the magnetic separator after the dust filter, which draws air out through the sorting chamber, provides the advantage of, on the one hand, burdening the blower with relatively little dust, i.e. fine particles of material, and, on the other hand, enabling the implementation of the previously described construction, by operating the magnetic separator at a negative pressure.

Preferably, an acceleration track for the material particles is provided after the means for the dispersed output of the material particles into the sorting chamber, or rather into the stream of conveying air leading into the sorting chamber. This acceleration track serves the purpose of accelerating the dispersed output of material particles to the velocity of the conveying airflow for a short distance. This can, for example, be done by means of a constriction in the cross-section of the lines leading into the sorting chamber. In addition, further means of enhancing the dispersed output of the material particles in the stream of conveying air, for example cams, offset teeth, or also static mixers, can be provided at the location or in the area having the narrowest cross-section.

A diffuser for the purpose of further dispersing the material particles in the stream of conveying air can be provided for after the means for the dispersed output of the material particles into the stream of conveying air and prior to or upon their entering the sorting chamber. The diffuser can, for example, be implemented by enlarging or expanding the cross-sectional area of flow in the lines. It serves the purpose of further dispersing the mixture of material particles and the stream of conveying air and regulating the flow velocity to the desired entry velocity. It is advantageous, in this context, for the diffuser to have a flare angle of between 4° and 6° in order to minimize any flow separation and/or demixing. A further advantage of providing a diffuser is that the flow velocity of the stream of conveying air in the sorting chamber is reduced, thus enabling the stream of conveying air to skim past the outer surface of the cylinder in a slow and linear manner.

A device for inducing opposing or reverse flow rotations in the stream of conveying air can be arranged in the sorting chamber, in particular in the entry area for the stream of conveying air. Said device can, for example, be designed as a triangular metal sheet and/or one with an adjustable angle, by means of the shape and orientation of which two counter-rotating airflows are induced. Inducing these rotations into the airflow makes it more likely that, before exiting the sorting chamber, all of the magnetizable material particles will make their way at least once to the vicinity of the outer surface of the cylinder, thus being adequately subjected to the influence of the magnetic field in order to be attracted towards the outer surface of the cylinder. A further advantage is that a greater cross-section and thus a higher flow rate through the sorting chamber is enabled by providing for rotations in the airflow, since it is thus no longer absolutely necessary for the magnetic field to be sufficiently strong across the entire cross-section of the sorting chamber, given that, by inducing the rotations into the airflow, the material particles conveyed are additionally transported from areas with an insufficiently strong magnetic field to areas with a sufficiently strong magnetic field.

In principle, the cross-section of the sorting chamber can have any desired shape. It is advantageous for the sorting chamber to have a rectangular cross-section with rounded or bevelled corners. A cross-section of this kind has proven to be advantageous because it is particularly well adapted to the magnetic field generated by the magnetic device, thus being able to ensure in a simple manner that there are no or very limited areas where the magnetic field does not act with sufficient strength.

Advantageously, the magnetic separator is designed to minimize the entry of false air. This is particularly relevant if the magnetic separator is to be operated under negative pressure. A design which minimizes the entry of false air will prevent unwanted air from being drawn from outside the magnetic separator and into the magnetic separator, in particular into the sorting chamber, consequently reducing the flow velocity in the sorting chamber. As a result of the latter, the blower will also require less energy in order to generate a desired flow velocity.

Preferably, the magnetic separator is continuously operable. That it is provided for that the magnetizable material particles being attracted to the outer surface of the cylinder are continuously discharged from the sorting chamber and into the collecting chamber, thus allowing the magnetic separator to be operated continuously plays a central role in this context. Also influential in this regard is the fact that the continuous feeding of material particles to be separated is made possible by means of the dispersed feeding into the stream of conveying air, which flows through the sorting chamber without interruption. A design of this kind has the advantage of being able to achieve a higher level of effectiveness since it is not necessary to stop and restart the system, for example in order to extract the magnetizable material particles.

It is advantageous for the length of the sorting chamber and/or the velocity of the stream of conveying air to be designed and configured so as to achieve a dwell time for the material particles in the sorting chamber of from 0.01 sec to 2 sec. On the one hand, dwell chambers of this kind have proven to be long enough for good purity and separation to be achieved between the two types of material particles, i.e. the magnetizable and the non-magnetizable ones. On the other hand, it is desirable to keep the dwell time as short as possible since doing so allows a higher throughput to be achieved with the same system.

Figure 2:
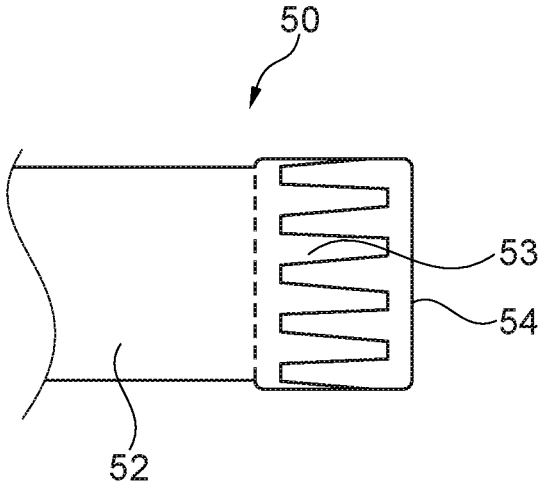
Figure 3:
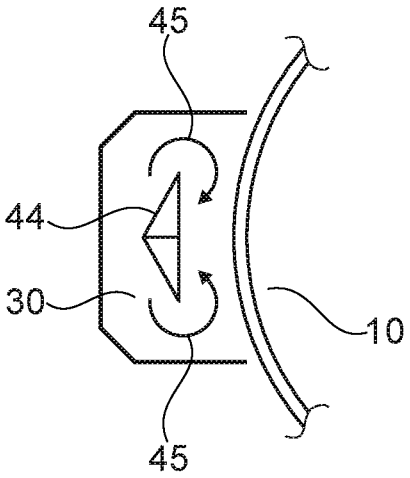
Figure 4:
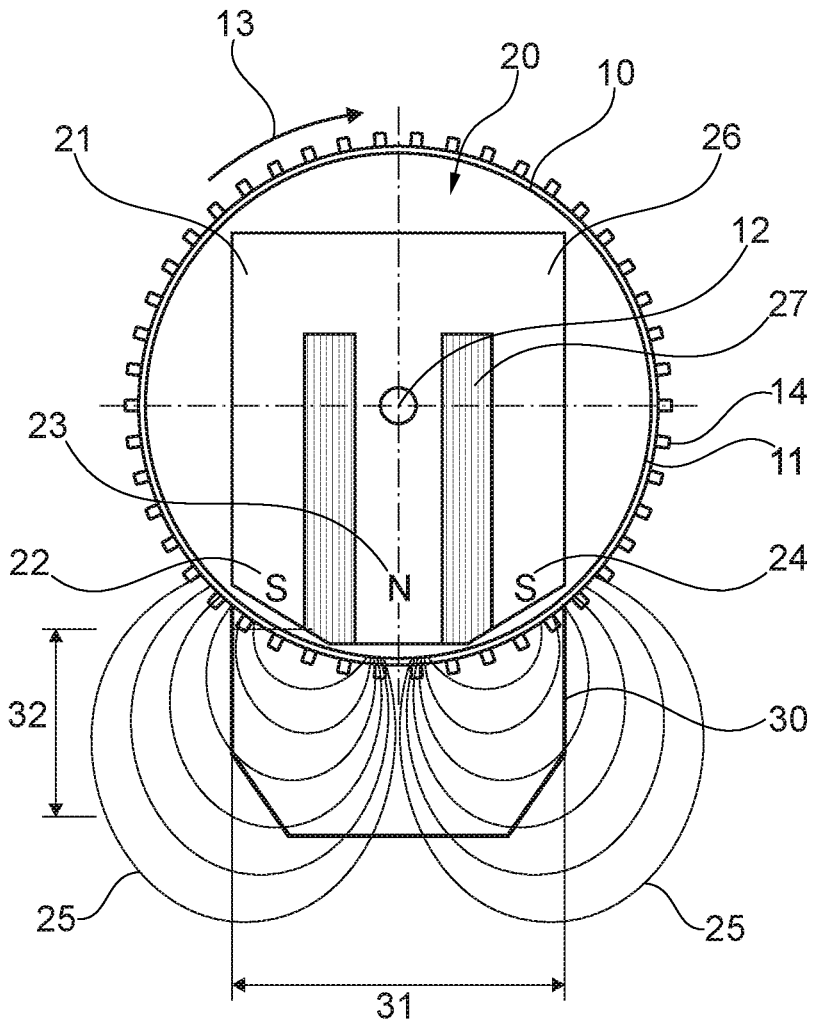
Figure 5:
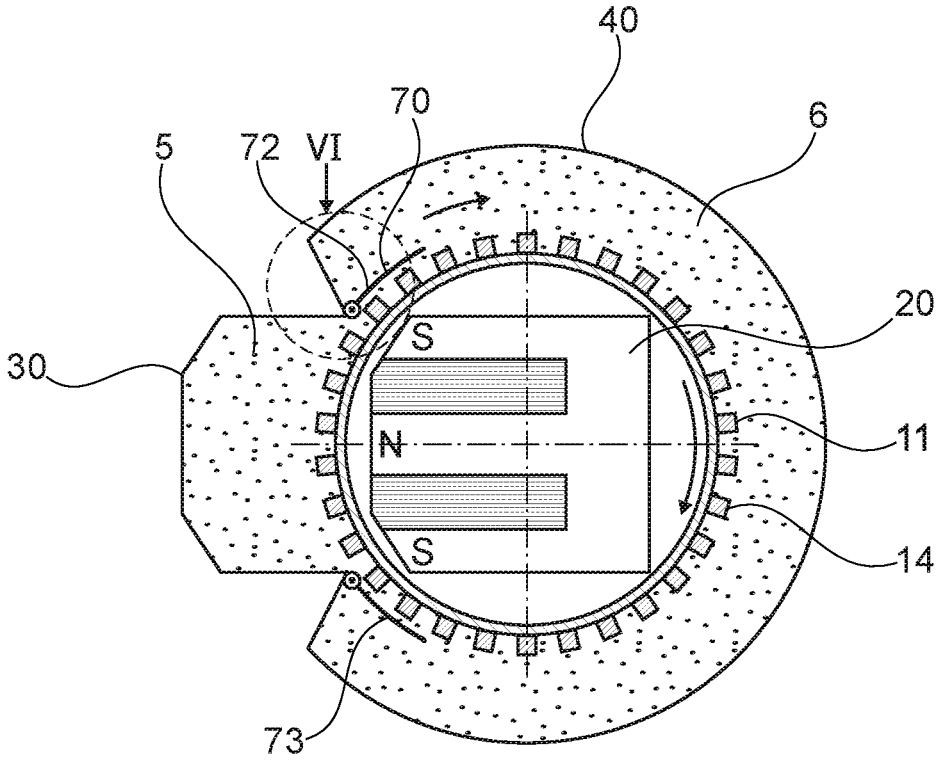
Figure 6:
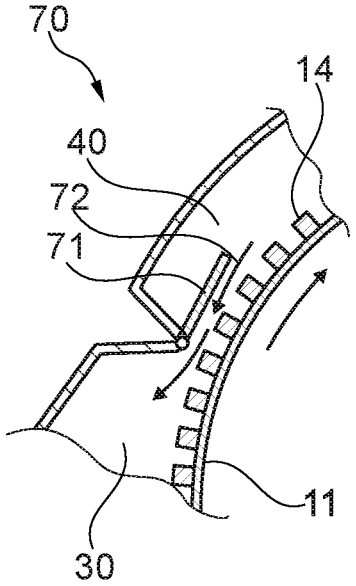
Figure 7:
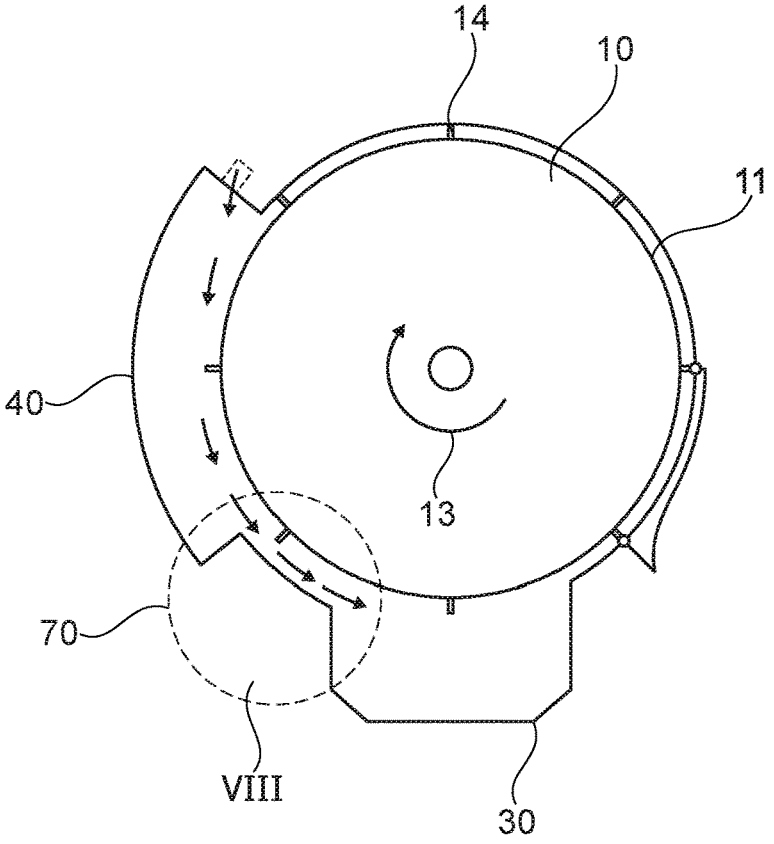
Figure 8:
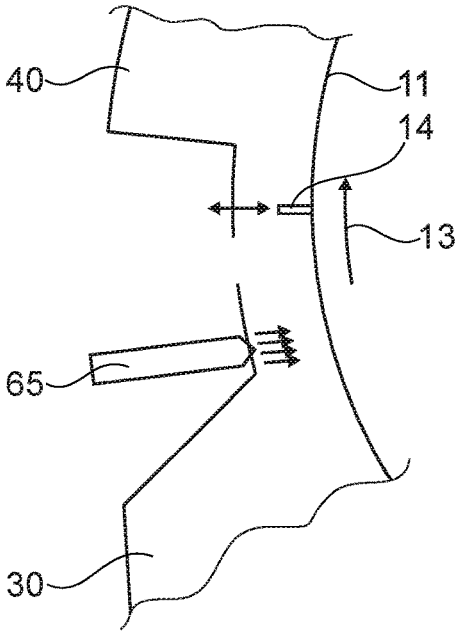

The invention will be explained in greater detail hereinafter by way of schematic embodiments, making reference to the drawings. Shown here are:

FIG. 1 a schematic overall view of a magnetic separator according to the invention;

FIG. 2 a view of the means for dispersed output corresponding to II in FIG. 1;

FIG. 3 a partial cutaway view along the line III in FIG. 3;

FIG. 4 a sectional view along the line IV in FIG. 1;

FIG. 5 a sectional view of a magnetic separator according to the invention;

FIG. 6 an enlargement of the area VI in FIG. 5;

FIG. 7 a sectional view of a magnetic separator according to the invention; and FIG. 8 an enlargement of the area VIII in FIG. 7.

FIG. 1 shows a schematic overall view of a magnetic separator 1 according to the invention; The construction and functioning thereof are explained in greater detail below, wherein both the components and the functioning are described going in the direction from the feeding of the material particles 5 to be separated toward the separation into magnetizable material particles 6 and non-magnetizable material particles 7.

In terms of the invention, "magnetizable and non-magnetizable material particles" 6, 7 means that these have different magnetic susceptibilities, and it is possible for the magnetizable material particles 6 to be more strongly influenced by a magnetic field than the non-magnetizable material particles 7. It is not absolutely mandatory in this context for the non-magnetizable material particles 7 to be completely unmagnetizable.

It should also be kept in mind that it is not mandatory for individual features of the magnet separator to be implemented together merely because they are shown and described together in an embodiment in the following description. It is also possible to implement only individual respective features in an embodiment of the magnetic separator and still regard it as being in line with the invention.

The material particles 5 to be separated are retained in a bunker 3, from which they are able to be conducted away via a screw conveyor 4 and transported to the magnetic separator 1 for separation. The material particles 5 being retained in the bunker in order to be separated may, for example, exhibit a fineness ranging from D90<30 μm to D90<500 μm. The material particles 5 make their way via the screw conveyor 4 to the means 50 for dispersed feeding of the material particles into a sorting chamber 30 in the magnetic separator 1.

The D90 value describes the particle size distribution in a grain distribution where 90% of the distribution is smaller than the reference grain diameter and 10% is larger.

Said means 50 can be designed in a variety of ways. In the embodiment shown in FIG. 1, an enlargement of which is shown in FIG. 2 in a view from top, the means 50 comprise an oscillating conveyor channel 52 with serrated ends 53. A feed hopper 54, which communicates with the line leading to the sorting chamber 30, is located under said ends 53.

The jags 53 on the end of the oscillating conveyor channel 52 serve to mechanically distribute the material particles 5 properly and as uniformly as possible across the entire cross-section of the feed hopper 54.

The magnetic separator 1 is operated at a negative pressure in relation to the environment. Provided for this purpose are means 60 for generating a stream of conveying air at the end of the magnetic separator 1, as is described more precisely below. By means of the negative pressure existing in the magnetic separator 1, ambient air is drawn through the feed hopper 54 as conveying air 61, into which the material particles 5 are dispersed.

Another option for the dispersed output of the material particles 5 is, for example, implementing the dispersed output by means of a metering belt and an air conveyor channel. Other options include providing for a rotating plate, onto which the material particles 5 are dispersed, and around which air circulates, thus dispersing the material particles 5 into the airflow separately. A siphon-like solution is likewise possible, which essentially corresponds to directly spraying the outlet from the bunker. Further mixing and dispersion can then be accomplished accordingly by means of directional changes, as well as mixers and/or turbulence-generating static or dynamic components provided for in the line from the bunker 3 to the sorting chamber 30.

In principle, static and/or dynamic components of this kind are also possible in the embodiment shown here.

In the embodiment illustrated in FIG. 1, an acceleration track 41 is provided for prior to the entry of the stream of conveying air 61, along with the material particles 5, into the sorting chamber 30. Said acceleration track 41 is primarily implemented by constricting the cross-section of the lines, and is used for a continuous acceleration of the material particles 5 in the conveying air 61. In addition, deflecting bodies, such as cams or offset teeth and/or a static mixer can be installed in the narrowest portion of the acceleration track 41 in order to achieve further dispersion, i.e. as even a distribution as possible of the material particles 5 in the stream of conveying air 61.

The flow velocity in the sorting chamber 30 can, for example, be regulated via the potency of the means 60 for generating the stream of conveying air, which will be described in greater detail below. In the context of the acceleration track 41, it is also possible to provide for a flat Venturi nozzle, which likewise influences the flow velocity of the stream of conveying air 61 flowing into the sorting chamber 30, thus also influencing the conveying air velocity.

In the embodiment shown here, it is assumed that both the acceleration and the mixing of the material particles 5 in the stream of conveying air 61 have largely been concluded, and that the distribution is as uniform as possible at the end of the acceleration track 41. In order to achieve the best possible separation of the magnetizable particles 6 and the non-magnetizable particles 7, it is desirable for the material particles 5 to be guided as slowly as possible past a magnetic device 20, which will be described in greater detail below. However, given that doing so would reduce the attainable throughput, it is desirable for the material particles 5 to be guided past the magnetic device 20 as quickly as possible, in which context, however, a dwell time of sufficient duration needs to be achieved within the magnetic field.

A diffuser 42 mounted before the entrance into the sorting chamber 30 can be provided for, for this purpose. As a result, it is achieved that the stream of conveying air 61 is broadened and the material to be sorted possibly further dispersed, thus enabling good separation. The diffuser 42 can, for example, be implemented by widening the conveying cross-section, in which case, in order to minimize flow separations and/or demixing, the angle of the diffuser 42 should ideally measure between 4° and 6°. Enlarging the flow area furthermore accomplishes a reduction in the velocity of the stream of conveying air 61 along with the material particles 5, thus allowing said stream of conveying air and material particles to be transported more slowly through the magnetic field 25 (which will be explained in greater detail below), thereby allowing the exposure time to be increased.

The stream of conveying air 61, along with the material particles 5, subsequently flows as slowly as possible, and in a straight line, through the ensuing sorting chamber 30. The sorting chamber 30, an example of which is shown in FIG. 4, has an essentially rectangular cross-section with rounded and/or bevelled corners. A longitudinal side of the sorting chamber 30 is bordered by a rotating cylinder 10. Located inside the cylinder 10 is a magnetic device 20, which is preferably designed as a tripolar magnet 21. The cylinder 10 is advantageously made from a non-magnetizable or hardly magnetizable material, for example aluminium.

The construction of the magnetic device 20, as well as that of the cylinder 10, is described in more detail below, making reference to FIG. 4.

As already described, the magnetic device 20 is preferably a tripolar magnet 21. The embodiment described here relates to a solenoid. In terms of the invention, "tripolar" is understood to mean that the magnetic device 20 is designed in such a way that it comprises a central pole 23 and two additional poles 22 and 24, which are arranged laterally with respect to said central pole 23 and act contrary thereto. In other words, the pole of the two outer magnets collapses at the central pole 23.

The embodiment of the magnetic device 20 illustrated in FIG. 4 is a solenoid, which comprises an iron core 26, as well as a coil 27 for generating the magnetic field 25. The coil in this case is wound around the central pole 23. The magnetic field 25 extends essentially along the direction of flow in the sorting chamber 30. In this context, the width 31 and depth 32 of the sorting chamber 30 are designed in such a way that the magnetic field 25 fills the interior of the sorting chamber 30 as completely as possible. In particular, this means that the magnetic field 25 within the sorting chamber 30 is strong enough to attract the magnetizable material particles 6.

The magnetic device 20 itself is located inside the cylinder 10, and is essentially hermetically sealed from the environment. This has the advantage of magnetizable particles 6 not being able to make their way directly to the magnet, which they would be able to limit the performance of and/or eventually contaminate.

By means of the magnetic field 25, the magnetizable particles 6 are attracted to and adhere to an outer surface 11 of the cylinder 10. The cylinder 10, which may also be referred to as a drum, is designed in such a way as to be able to rotate around its longitudinal axis 12. A motor 18 is provided for, for this purpose. As indicated in FIG. 4, due to the direction of rotation 13 of the cylinder 10, a portion of the outer surface 11 is rotated out of the sphere of action of the magnetic field 25. This portion is located outside the sorting chamber 30. Since the magnetic field 25 is no longer active in this area, or is rather no longer strong enough, the magnetizable particles 6 in turn fall away from the outer surface 11 of the cylinder 10, and can then be discharged from the magnetic separator 1. In addition, cam bars 14 are provided for on the outer surface 11 for improved removal of the magnetized particles 6 from the sorting chamber 30. When the cylinder 10 rotates out of the magnetic field 25 and the magnetizable particles 6 are no longer attracted by the magnetic field 25, the provision of cam bars 14 on the outer surface 11 prevents said particles from basically sliding along the outer surface 11 of the cylinder 10 and not following the rotation. In other words, they are prevented from failing to rotate out of the magnetic field. The transport of the magnetizable particles 16 out of the magnetic field 25 is facilitated as a consequence of the cam bars 14 constituting an increase in elevation.

Other corresponding devices can also be provided for on the outer surface 11 of the cylinder 10 as an alternative or in addition to the cam bars 14. Examples in this regard include grooves, recesses, etc.

As follows from FIG. 1, located after the sorting chamber 30 is a collecting chamber 40, in which the magnetizable particles 6 are caught. A rotary airlock 47 is located at the lower end of the collecting chamber 40, for example, in order to extract the magnetizable particles 6 from the collecting chamber 40 without increasing the air leakage into the magnetic separator 1. Of course, the extraction device can also be designed in a different way as long as the air leakage is minimized in doing so.

The non-magnetizable material particles 7 remain in the sorting chamber 30 to be transported via the stream of conveying air 61 in the direction of a dust filter 80. The non-magnetizable material particles 7 are separated from the stream of conveying air 61 in this filter 80, and can subsequently likewise be removed from the magnetic separator 1 via a second rotary air lock 37. A blower 62, which acts as a means 60 of generating the stream of conveying air and drawing air through the magnetic separator 1, is connected to the dust filter 80.

In particular the area between the sorting chamber 30 and the collecting chamber 40 is explained in greater detail below, making reference to FIGS. 5 and 6. In this context, an enlargement of the area VI in FIG. 5 is shown in FIG. 6. Both drawings illustrate a cross-section through a magnetic separator 1 according to the invention.

As already described, the magnetic separator 1 is operated at a negative pressure in relation to the ambient air. It is additionally provided for that the static pressure present in the collecting chamber 40 is higher than that in the sorting chamber 30. This means that air or gases will tend to flow from the collecting chamber 40 towards the sorting chamber 30. In order to influence the volume and/or velocity thereof in particular, a sealing area 70 is provided for at the point where the sorting chamber 30, the collecting chamber 40, and the outer surface 11 of the cylinder 10 meet. Due to the differences in pressure, a stream of air flows from the collecting chamber 40 through this sealing area 70 in the direction the sorting chamber 30. Accordingly, devices such as seals or lips able to minimize or have an influence on the airflow are provided for in the sealing area 70.

In the embodiment shown in regard to FIGS. 5 and 6, a seal 72 is provided for in the area where the sorting chamber 30 and the collecting chamber 40 meet. This seal is larger, and in particular longer, than the distance between two cam bars 14, thus interacting with the cam bars 14 to create a sort of chamber having a confined air volume, which acts as an airlock for transferring air from the collecting chamber 40 to the sorting chamber 30. The distance between the seal 72 and the top of the cam bar 14 can be adjusted, as a result of which the flow of air from the collecting chamber 40 to the sorting chamber 30 can be adjusted.

In this context, the cam bars 14 also serve the purpose of improving the air seal between the sorting chamber 30 and the collecting chamber 40. In principle, the distance between the seals and the cam bars 14 can be designed to be adjustable. This means that the airflow 71 generated, which is formed contrary to the direction of rotation 13 of the cylinder 10, can be adjusted. The airflow 71 has the function of blowing adhesive magnetizable 6 and non-magnetizable 7 material particles away from the outer surface 11 or the cam bars 14, and blowing them back into the sorting chamber 30. Post-purification of the material particles 5 can be achieved in this way. Of course, the air flow 71 is not adjusted to such a great extent that all the material particles 5 are generally blown away. As already described, the strength and volume of the airflow 71 can be varied by adjusting the seals. In this connection, an air inlet for the collecting chamber 40 is provided for, which can likewise be used to vary the volume of air flowing into the collecting chamber, thereby allowing the flow of air 71 to be influenced, as well.

In a similar fashion, another seal 73 is provided for on the other side of the point where the collecting chamber 40 and the sorting chamber 30 meet, as illustrated in FIG. 5. It is desirable in this case to have the best seal possible.

A further device can also be provided for, in order to improve the purity of the magnetizable material particles 6. This will be explained in greater detail below with reference to FIGS. 7 and 8. FIG. 7 likewise shows a schematic diagram of a section through a magnetic separator 1 according to the invention, wherein FIG. 8 is an enlarged illustration of the area VIII in FIG. 7. This once again relates to the sealing area 70.

In addition to the airflow, cleaning nozzles 65 are provided for, in this case, which actively blow air onto the outer surface 11 of the cylinder 10. This active blowing of air can be carried out by actively injecting air, but it is also possible to draw in air in this direction by way of the existing negative pressure. The point of the additional cleaning nozzles 65 is similar to that of the airflow 71 in that the material present on the outer surface 11 is blown away, with further cleaning being provided in the sorting chamber 30.

As described below with reference to FIG. 3, an even better separation performance can be achieved by providing for a device for inducing flow rotations 44 in the sorting chamber 30. Said device can, for example, be designed in the form of a triangular and metal sheet where the angle can be adjusted, or a delta wing. It is significant in this regard that said device induces two flow rotations 45, which move in opposite directions and additionally ensure that material particles 5 located inside the sorting chamber 30 are conveyed as closely as possible to the outer surface 11 of the cylinder 10, in order for the magnetizable particles 6 to be attracted to the outer surface 11.

The stream of conveying air 61 in the sorting chamber 30 should be as uniform, in particular as laminar, as possible. In terms of the invention, this can be regarded as being as parallel as possible to the drum or the magnetic axis, wherein this also encompasses the induced flow rotations previously described. Preferably, the velocity of the stream of conveying air 61 is adjusted in such a way that it approximately corresponds to the collective terminal velocity of the material particles 5. This means that a non-dispersed output is assumed. The velocity in this case is normally in the range of between 3 m/sec and 7 m/sec.

A variety of effects can be achieved by varying the flow velocity. By means of a higher, meaning a faster, flow velocity of the stream of conveying air 61 in the sorting chamber 30, a higher throughput is achieved given a constant dust load, i.e. the same material particle loading 5 per volume of conveying air 61. With a constant throughput, the dust loading, or rather the loading of material particles, is reduced, thereby increasing the purity of the magnetizable material particles 6 being expelled in the collecting chamber 40.

If the flow velocity of the stream of conveying air 61 is reduced, then the dwell time in the magnetic field 25 is increased, and thus the extraction of magnetizable particles 6 in the portion expelled.

As follows from the overall concept of the magnetic separator 1, the key features for the magnetic separator 1 according to the invention are that the material particles 5, which are to be separated, are to be transported in a uniform flow with the stream of conveying air 61. It is additionally key that the stream of conveying air 61 and the direction of rotation 13 of the cylinder 10 are orientated in directions essentially perpendicular to one another so that the magnetizable material particles 6 accumulated on the outer surface 11 of the cylinder 10 are removed from the magnetic field 25 as quickly as possible, thus having essentially no influence on the performance of the magnetic device 20. If these material particles were to remain accumulated, then the resultant magnetic field 25 would eventually weaken and the degree of efficiency of the magnetic separator 1 worsen.

In principle, it is also possible to arrange multiple magnetic separators 1 according to the invention one after the other in order to produce various different material qualities, depending on the strength of the magnetic field and the individual material particles 5 to be sorted. In a similar fashion, it is also possible to implement this by means of a split collecting chamber 40, in which material with properties that are different from those of the material in a lower area is collected in an upper area. It is also possible, in this respect, to provide for magnetic devices 20 of varying strength along the longitudinal axis of the cylinder.

Using the magnetic separator 1 according to the invention will, moreover, achieve an extremely favourable law of growth in comparison to similarly constructed magnetic separators from the prior art.

In order to increase the throughput in conventional drum magnetic separators, this can as a rule only be achieved by increasing the width of the drum, increasing the permissible thickness of the layer of magnetizable particles, and/or increasing the drum speed, meaning the speed of rotation. As already described, the thickness of the layer of material on the drum cannot be achieved without a negative impact on the removal, purity, and strength of the magnetic field. It is a similar situation with the drum speed. Beyond a certain drum speed, the centrifugal force is so great that the material particles attracted are hurled away again due to the rotation, and are thus unable to be conveyed out of the magnetic field by means of the drum. Given that both the discharge velocity of the drum and the thickness of the layer on the drum should be held constant when increasing the dimensioning, this means for the most part that the throughput can only be increased by way of the drum width. This is also justified by virtue of the fact that, in contrast to the invention, it is not the case with known drum magnetic separators that essentially only magnetizable particles are attracted to the drum. In consequence, it is desirable with conventional drum magnetic separators for the layer of magnetizable particles on the drum to be as thin as possible, ideally meaning one grain thick.

On the other hand, according to the invention, it is possible, through the sorting chamber, to expand it in all three directions—length, width, and height. If the flow velocity in the sorting chamber is held constant, then the throughput of the magnetic separator according to the invention will, in this case, increase quadratically, rather than proportionality, as is the case with the prior art. If the flow velocity can likewise be increased with a bigger system and size, then the resulting growth law will be even more dynamic. The advantage of the solution according to the invention in comparison to known drum magnetic separators is demonstrated in this respect: With the magnetic separator according to the invention, it is not necessary to provide for only a thin, single-grain thickness of the magnetizable particles on the drum because, due to the particles being dispersed in the stream of conveying air and the overall construction of the magnetic separator, essentially only magnetizable particles are present on the drum, or rather on the outer surface of the cylinder. Thus, unlike with the known magnetic drum separators, no rotational speed problem arises. In addition, how slowly the drum turns and how thick the layer of magnetizable particles on the drum is has no impact on purity.

Such a favourable growth law offers the advantage of the magnetic separator 1 being able to be used even with greater system sizes without that necessarily leading to uneconomical dimensions.

Using the magnetic separator according to the invention, it is consequently possible to separate fine particles of material in the order of from D90<30 μm to D90<500 μm in a dry and efficient manner.

The invention claimed is:

1. A magnetic separator for the dry separation of material particles having different magnetic susceptibilities, comprising:

a cylinder rotatable around a longitudinal axis, a stationary magnetic device arranged within the cylinder and extending essentially across the length of the cylinder, said magnetic device being designed to generate a continuous magnetic field in the longitudinal direction of the cylinder, a sorting chamber, which extends along a portion of the outer surface of the cylinder in the circumferential direction of the cylinder and parallel to the longitudinal axis of the cylinder, along the height of the cylinder, a collecting chamber connected to the sorting chamber in the direction of rotation of the cylinder is provided for, said collecting chamber being located essentially outside of the magnetic field of the magnetic device;

cleaning nozzles, through which air is blown against the outer surface of the cylinder, are provided for in the area between the outer surface of the cylinder and where the sorting chamber and the collecting chamber meet, means for the dispersed output of the material particles into the sorting chamber, means for generating a stream of conveying air through the sorting chamber, wherein, during operation, the material particles are conveyed through the sorting chamber by means of the stream of conveying air, with a motor for rotating the cylinder around its longitudinal axis, wherein, during operation, the outer surface of the cylinder is moved by the cylinder being rotated in a direction essentially perpendicular to the direction of the stream of conveying air; and wherein the magnetic device and the cylinder are designed and orientated with respect to one another in such a way that both the portion of the outer surface having the sorting chamber and the interior of the sorting chamber have a magnetic field that is strong enough to attract material particles onto the outer surface, wherein that the magnetic separator is operable at a negative pressure in relation to the environment by means of a blower, which draws air from the magnetic separator.

2. The magnetic separator according to claim 1, wherein:

the magnetic device is designed as a tripolar magnet having an N-S-N or an S-N-S orientation of the poles.

3. The magnetic separator according to claim 1, wherein:

cam bars are formed on the outer surface of the cylinder.

4. The magnetic separator according to claim 1, wherein:

during operation, the pressure created in the collecting chamber is higher than that in the sorting chamber.

5. The magnetic separator according to any of claim 1, wherein:

a sealing area, by means of which a stream of air from the collecting chamber to the sorting chamber is adjustable, is formed in the area between the outer surface of the cylinder and where the sorting chamber and the collecting chamber meet.

6. The magnetic separator according to claim 1, wherein:

the means for generating a stream of conveying air through the sorting chamber comprises a blower for the magnetic separator is provided for at the end of the magnetic separator.

7. The magnetic separator according to claim 1, wherein:

a dust removal filter is arranged after the sorting chamber.

8. The magnetic separator according to claim 1, wherein:

an acceleration track for the material particles is provided after the means for the dispersed output of the material particles into the sorting chamber.

9. The magnetic separator according to claim 1, wherein:

a diffuser for the purpose of further dispersing the material particles into the stream of conveying air is provided after the means for dispersed output of the material particles and at the entrance to the sorting chamber.

10. The magnetic separator according to claim 1, wherein:

a device for inducing opposing flow rotations in the stream of conveying air is arranged in the sorting chamber in the entry area for the stream of conveying air.

11. The magnetic separator according to claim 1, wherein:

the sorting chamber has an essentially rectangular cross-section with rounded or bevelled corners.

12. The magnetic separator according to claim 1, wherein:

the magnetic separator can be operated continuously.

13. The magnetic separator according to claim 1, wherein:

the length of the sorting chamber and the velocity of the stream of conveying air are designed and configured to achieve a dwell time for the material particles in the sorting chamber of from 0.01 sec to 2 sec.

* * * * *